US007578276B2

(12) United States Patent
Matsuura et al.

(10) Patent No.: US 7,578,276 B2
(45) Date of Patent: Aug. 25, 2009

(54) AUTOMATIC TAPPET CLEARANCE ADJUSTING DEVICE

(75) Inventors: Junichi Matsuura, Sayama (JP); Takehisa Handa, Sayama (JP); Tomoaki Tsuyoshi, Sayama (JP)

(73) Assignee: Honda Motor Co., Ltd., Tokyo (JP)

( * ) Notice: Subject to any disclaimer, the term of this patent is extended or adjusted under 35 U.S.C. 154(b) by 232 days.

(21) Appl. No.: 11/664,201

(22) PCT Filed: Sep. 28, 2005

(86) PCT No.: PCT/JP2005/017897

§ 371 (c)(1),
(2), (4) Date: Mar. 29, 2007

(87) PCT Pub. No.: WO2006/035845

PCT Pub. Date: Apr. 6, 2006

(65) Prior Publication Data

US 2008/0022956 A1 Jan. 31, 2008

(30) Foreign Application Priority Data

Sep. 29, 2004 (JP) ..... 2004-282945

(51) Int. Cl.
*F01L 1/14* (2006.01)

(52) U.S. Cl. ..... 123/90.52; 123/90.45; 123/90.54

(58) Field of Classification Search ..... 123/90.39, 123/90.44, 90.48, 90.52, 90.43, 90.45, 90.54, 123/90.65

See application file for complete search history.

(56) References Cited

U.S. PATENT DOCUMENTS

| | | | |
|---|---|---|---|
| 6,205,850 | B1 | 3/2001 | Wehrman et al. |
| 6,917,874 | B2 * | 7/2005 | Uchida et al. ..... 701/108 |

FOREIGN PATENT DOCUMENTS

| | | |
|---|---|---|
| GB | 1 603 113 | 11/1981 |
| JP | 56-077505 | 6/1981 |
| JP | 58-057016 | 4/1983 |
| JP | 63-266105 | 11/1988 |
| JP | 06-017619 | 1/1994 |
| JP | 09-177520 | 7/1997 |
| JP | 09-303120 | 11/1997 |
| JP | 10-077812 | 3/1998 |
| JP | 11-153007 | 6/1999 |
| JP | 2001-027106 | 1/2001 |
| JP | 2002-115512 | 4/2002 |
| JP | 2004-245111 | 9/2004 |

* cited by examiner

*Primary Examiner*—Ching Chang
(74) *Attorney, Agent, or Firm*—Carrier, Blackman & Associates, P.C.

(57) ABSTRACT

An automatic tappet clearance adjusting device, comprising an adjusting unit adjusting the projected amount of a rocker arm by advancing and retreating an adjust screw to and from the tip of the rocker arm, a pressure setting part electrically controlling the pressure of an air supply source part based on the measurement signals of a primary side pressure sensor measuring the pressure of the air supply source part so that the pressure becomes a specified one, a supply pipeline allowing the air supply source part to communicate with a combustion chamber through a variable orifice, and a control mechanism part controlling the adjusting unit based on measurement signals of a secondary side pressure sensor measuring the pressure of the supply pipeline. The pressure is set to 1.5 kPa by the pressure setting part and the variable orifice.

5 Claims, 13 Drawing Sheets

AUTOMATIC TAPPET CLEARANCE ADJUSTING DEVICE

CROSS-REFERENCE TO RELATED APPLICATIONS

The present application is a U.S. National phase of, and claims priority based on PCT/JP2005/017897, filed 28 Sep. 2005, which, in turn, claims priority from Japanese patent application 2004-282945, filed 29 Sep. 2004. The entire disclosure of each of the referenced priority documents is incorporated herein by reference.

TECHNICAL FIELD

The present invention relates to an automatic tappet clearance adjusting apparatus for adjusting a clearance between a valve and an adjustment screw in an engine, in which the valve that is closed by a spring is opened by being pressed by an adjustment screw on a distal end of a rocker arm.

BACKGROUND ART

Engines of the type in which a rocker arm is provided in a valve mechanism draw in and discharge a fuel gas and an exhaust gas by pressing a valve end, so as to open the valve with an adjustment screw on the distal end of a rocker arm that is actuated by a cam. When the rocker arm returns to an original position, the valve is closed again under a resilient force of a spring.

A clearance (hereinafter referred to as a tappet clearance) is provided between the valve end and the adjustment screw, for allowing the valve to be fully closed when the rocker arm returns to the original position. If the tappet clearance is too small, then the clearance may possibly be eliminated due to thermal expansion at high temperatures. If the tappet clearance is too large, then the valve end and the adjustment screw produce large sounds as noise when they contact each other. Therefore, the tappet clearance has to be adjusted accurately to an appropriate value (or within an appropriate range) that is preset in design. Particularly, a process for manufacturing a large quantity of engines in a wide variety of types needs to have a reduced adjustment time per engine, while maintaining a high adjustment accuracy level. It is preferable to be able to adjust the tappet clearance automatically in order to prevent adjustment fluctuations.

Processes for adjusting tappet clearances are described in Japanese Patent Publication No. 5-35243 and Japanese Laid-Open Patent Publication No. 11-153007. According to the valve clearance setting process described in Japanese Patent Publication No. 5-35243, an intake passage and an exhaust passage, which are opened and closed by valves, are sealed, and compressed air of a predetermined pressure is introduced into the intake passage and the exhaust passage. Then, adjustment screws engaging rocker arms are threaded in, so as to press and open the valves, until the pressure in the intake passage and the exhaust passage is lowered to a given pressure. Thereafter, the adjustment screws are rotated a predetermined angular interval in a direction opposite to the direction in which they were threaded in, for thereby closing the valves and providing a predetermined clearance between the valves and the adjustment screws. This method is capable of appropriately setting the valve clearance with considerable accuracy.

According to the process described in Japanese Laid-Open Patent Publication No. 11-153007, the tappet clearance is adjusted while the pressure in the combustion chamber that is supplied with air under high pressure is being monitored. The tappet clearance can be adjusted accurately almost without requiring any skill.

According to the process described in Japanese Laid-Open Patent Publication No. 11-153007, because the pressure inside the combustion chamber is relatively high, air flow tends to be disturbed, and hence accurate measurements cannot be made until the pressure in the combustion chamber becomes stabilized. Accordingly, it may be difficult to adjust the tappet clearance quickly. In particular, this process is not appropriate for adjustment of tappet clearances of a large quantity of engines having a wide variety of engine types.

According to the process, since the worker uses a screwdriver to adjust the distance that the adjustment screw is threaded in, it would be desirable to make the process automatic in order to reduce the burden on the worker as well as to adjust the tappet clearance with higher accuracy in a shorter period of time.

According to the process of pressurizing the combustion chamber in the processes disclosed in Japanese Patent Publication No. 5-35243 and Japanese Laid-Open Patent Publication No. 11-153007, the supplied pressure cannot catch up with an air leakage from the gap in the piston ring. Since different amounts of air leak through the ring gaps in various engine types, an adjusting apparatus needs to be prepared respectively for each of the engine types.

DISCLOSURE OF THE INVENTION

It is an object of the present invention to provide an automatic tappet clearance adjusting apparatus, which is capable of adjusting a clearance between a valve and a rocker arm (tappet clearance) more quickly and accurately.

Another object of the present invention is to increase the pressure catch-up rate of an air supply source with respect to air leakage from a gap in a piston ring, so as to provide a stable pressure that is applicable to a large quantity of engines in a wide variety of engine types with different ring gap shapes.

Still another object of the present invention is to measure a pressure or flow rate change when a valve is opened and closed under stable conditions, so as to accurately identify a reference point for closing the valve, and so that the clearance between the valve and an adjustment screw can be adjusted more quickly and accurately.

According to the present invention, an automatic tappet clearance adjusting apparatus for adjusting a clearance between a valve and an adjustment screw in an engine, in which the valve that is closed by a spring is opened by being pressed by an adjustment screw on a distal end of a rocker arm, comprises an adjustment unit for advancing and retracting the adjustment screw from the distal end of the rocker arm to adjust a projection of the adjustment screw, a pressure setting unit for adjusting the pressure of an air supply source so as to maintain a constant pressure in accordance with an electric feedback loop and based on a measured signal from a primary pressure sensor for measuring the pressure of the air supply source, a supply pipe extending from the air supply source and communicating with a combustion chamber through a restriction and an ignition plug hole, and a control mechanism for controlling the adjustment unit based on a measured signal from a secondary pressure sensor for measuring the pressure in the supply pipe, wherein the pressure in the supply pipe and the combustion chamber when the valve is closed is set to a pressure in the range from 0.5 to 20.0 kPa.

Since the pressure of the air supply source is adjusted by the pressure setting unit according to an electric feedback loop, and the pressure in the supply pipe and the combustion chamber is set to a very low pressure in the range from 0.5 to 20.0 kPa, a stable pressure is obtained, whereby the tappet clearance can be adjusted quickly with high accuracy. Inasmuch as a very low pressure is used, heat generated by energy loss is small, and the air that passes through the restriction experiences only a small air viscosity change due to changes in temperature. Since the pressure loss across the restriction is small, air flow disturbances likewise are small, and pressures can be measured more stably. As a result, the measurement of pressures is not susceptible to heat and flow disturbances, and measurements can be performed highly accurately with reduced fluctuations. A reference point for closing the valve can be identified highly accurately.

The control mechanism may retract the adjustment screw from a state in which the valve is open, detect a point, as a reference point, in which the valve is closed and the measured signal from the secondary pressure sensor exceeds a predetermined threshold, and then retract the adjustment screw by a preset interval based on the clearance from the reference point. Thus, a position for closing the valve can accurately be detected as a reference point, and the tappet clearance can be adjusted with higher accuracy.

If the restriction comprises a variable orifice, then it is easy to set the pressure inside the supply pipe and the combustion chamber.

If the adjustment unit is moved by a programmable multi-axis robot, then the adjustment unit is flexible enough to handle engines in which the rocker arms and adjustment screws thereof have different positions and directions.

If a piston of the engine is set to a top dead center, then the volume of the combustion chamber is small enough to be filled with compressed air quickly, for enabling adjustments to be started early. If a small air leakage occurs when the valve is opened, then a noticeable pressure or flow rate variation occurs, allowing the behavior of the valve to be monitored with ease.

If the automatic tappet clearance adjusting apparatus is installed in a station on a production line, then the automatic tappet clearance adjusting apparatus can suitably be used to adjust mass-produced engines.

According to the present invention, an automatic tappet clearance adjusting apparatus for adjusting a clearance between a valve and an adjustment screw in an engine, in which the valve that is closed by a spring is opened by being pressed by an adjustment screw on a distal end of a rocker arm, comprises an adjustment unit for advancing and retracting the adjustment screw from the distal end of the rocker arm to adjust a projection of the adjustment screw, a pressure setting unit for adjusting the pressure of an air supply source so as to maintain a constant pressure in accordance with an electric feedback loop and based on a measured signal from a pressure sensor for measuring the pressure of the air supply source, a supply pipe extending from the air supply source and communicating with a combustion chamber, and a control mechanism for controlling the adjustment unit based on a comparison of a flow rate as a measured signal from a flow rate sensor with a predetermined threshold, the flow rate sensor measuring the flow rate of air in the supply pipe. Since the pressure of the air supply source is adjusted by the pressure setting unit according to an electric feedback loop, and the adjustment unit is controlled based on the flow rate of air in the supply pipe, a stable pressure is obtained, whereby the tappet clearance can be adjusted quickly with high accuracy.

The control mechanism may retract the adjustment screw from a state in which the valve is open, detect a point, as a reference point, in which the valve is closed and the measured signal from the flow rate sensor is smaller than a predetermined threshold, and then retract the adjustment screw by a preset interval based on the clearance from the reference point. Thus, a position for closing the valve can accurately be detected as a reference point, and the tappet clearance can be adjusted with higher accuracy.

BEST MODE FOR CARRYING OUT THE INVENTION

Automatic tappet clearance adjusting apparatuses according to first and second embodiments of the present invention shall be described below with reference to FIGS. 1 through 13 of the accompanying drawings.

Figure 1:
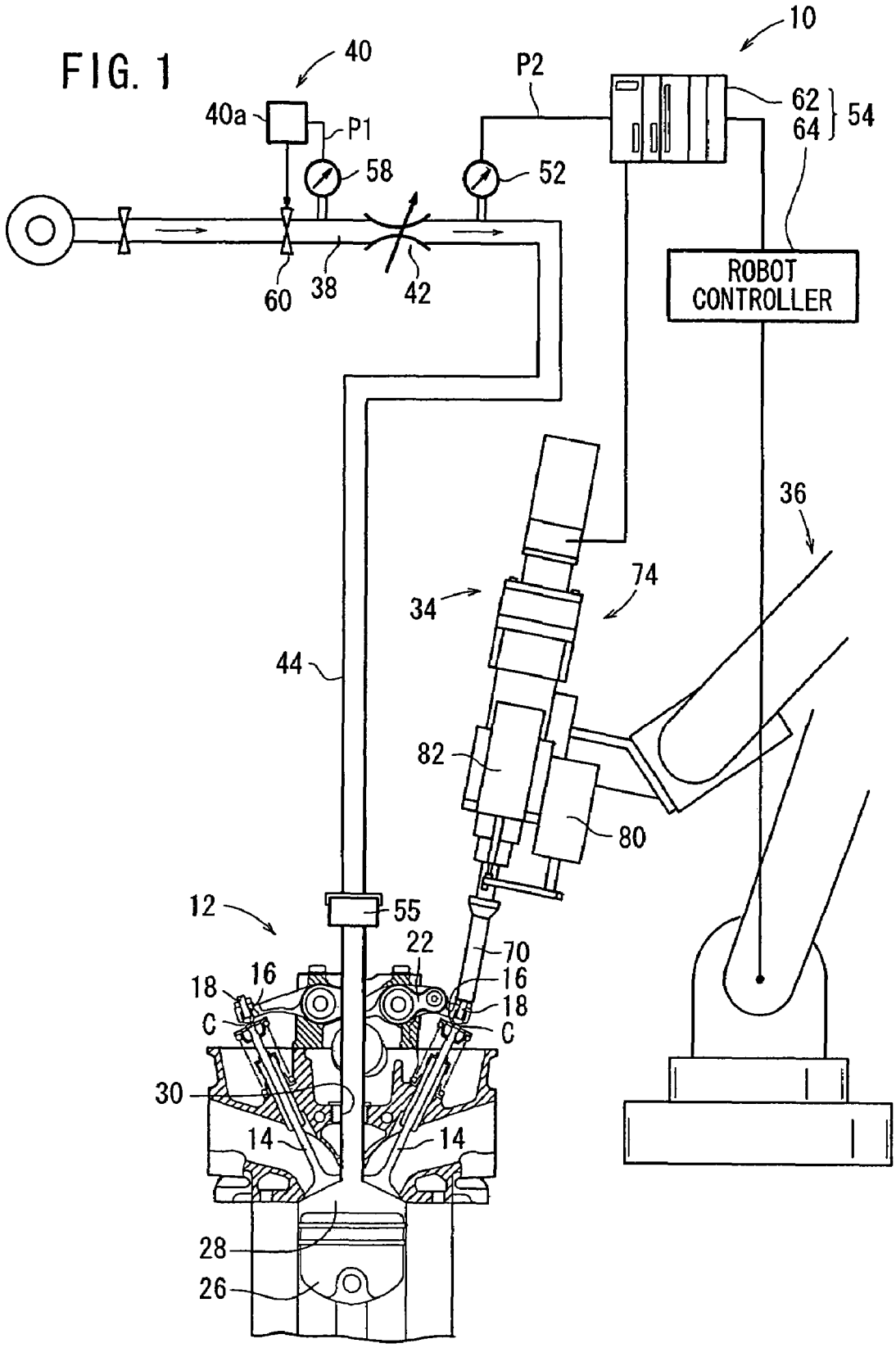
FIG. 1 is a block diagram of an automatic tappet clearance adjusting apparatus according to a first embodiment of the present invention.

As shown in FIG. 1, an automatic tappet clearance adjusting apparatus 10 according to a first embodiment of the present invention operates to adjust a clearance (hereinafter referred to as a tappet clearance) C between a valve end 16 of a valve 14 of an engine 12 and an adjustment screw 18. The adjustment screw 18 is a fine right-handed screw, which is advanced downwardly when rotated clockwise.

Figure 2:
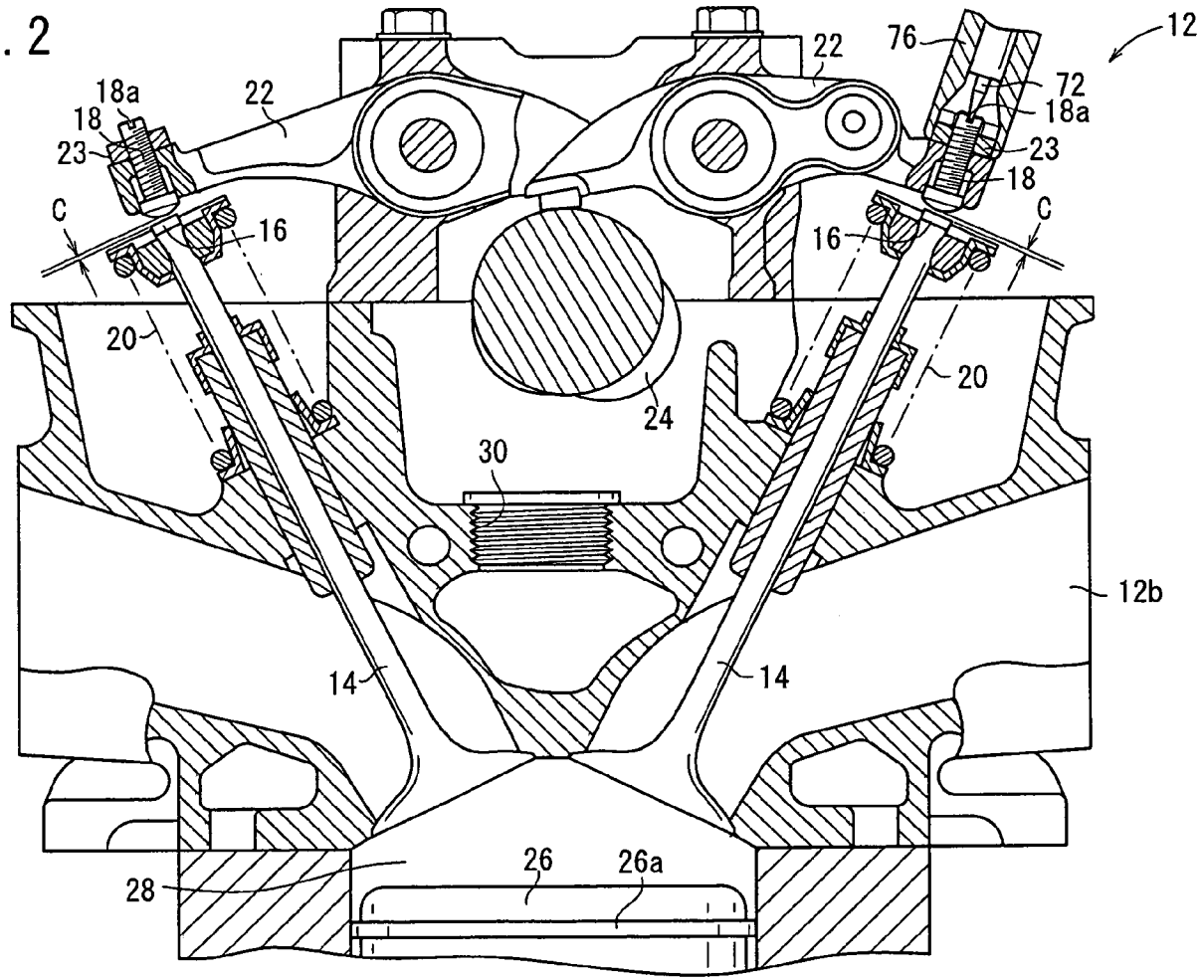
FIG. 2 is a cross-sectional view of an engine.

As shown in FIG. 2, the adjustment screw 18 has a screw section having a straight slot 18*a* defined in an upper end thereof, the screw section being threaded in the distal end of a rocker arm 22. The adjustment screw 18 is fixed in place by an adjustment nut 23, by means of a double-nut configuration. The engine 12 is of a type wherein the valve end 16 of the valve 14, which is normally closed by a spring 20, is pressed by the adjustment screw 18 on the distal end of the rocker arm 22 in order to temporarily open the valve 14. Specifically, the rocker arm 22 is actuated by a cam 24 so as to cause the adjustment screw 18 to press the valve end 16, for thereby opening the valve 14 to draw in a fuel gas or to discharge an exhaust gas. When the rocker arm 22 returns to its original position, the valve 14 is closed again under the resiliency of the spring 20.

For adjusting the clearance C, the cam 24 is set so that the cam lobe thereof is directed downwardly and the rocker arm 22 returns to its original position. Therefore, in both intake and exhaust strokes, the valves 14 are placed in positions for closing an intake pipe and an exhaust pipe, respectively, and a piston 26, which is ganged with the cam 24, is lifted to a top dead center position, providing a combustion chamber 28 as a small space. An ignition plug is removed, and a supply pipe 44, to be described later, is connected to an ignition plug hole 30.

With the adjustment nut 23 being loosened, the adjustment screw 18 advances or retracts in order to change the tappet clearance C when it is turned by a screwdriver (tool) 72 inserted into the straight slot 18*a* defined in the rear end of the adjustment screw 18. When the tappet clearance C is adjusted to a suitable value, the adjustment nut 23 is tightened in order to secure the adjustment screw 18.

Referring back to FIG. 1, the automatic tappet clearance adjusting apparatus 10 has an adjustment unit 34 for advancing and retracting the adjustment screw 18 after having loosened the adjustment nut 23, a robot (moving mechanism) 36 programmed for moving the adjustment unit 34 to a desired position in a desired direction, a pressure setting unit 40 for electrically adjusting the pressure of an air supply source 38 so as to maintain a constant pressure, a supply pipe 44 extending from the air supply source 38 and communicating with the combustion chamber 28 of the engine 12 through a dial-adjustable variable orifice (restriction) 42, and a control mechanism 54 for controlling the adjustment unit 34 based on a measured signal from a secondary pressure sensor 52, which measures the pressure in the supply pipe 44. The supply pipe 44 also includes an on-off valve 55.

The control mechanism 54 includes a PLC (Programmable Logic Controller) 62 and a robot controller 64. The PLC 62 stores successive measured signals from the secondary pressure sensor 52 in a given data register, performs calculations, controls the adjustment unit 34 based on the calculated results, etc., and transmits a predetermined timing signal to the robot controller 64. Based on the received timing signal, the robot controller 64 controls the robot 36 to move and bring the distal end of the adjustment unit 34 into abutment against the adjustment screw 18. The robot 36 comprises a multiaxis industrial robot.

Based on a measured signal from a primary pressure sensor 58, which measures a pressure P1 of the air supply source 38, the pressure setting unit 40 opens and closes a booster regulator 60 under a PID control in order to keep the pressure P1 constant. Specifically, the pressure setting unit 40 has a pilot regulator 40*a* for applying a pilot pressure to the surface of a diaphragm in the booster regulator 60. A nozzle is advanced or retracted to regulate the pressure P1 based on a balance between the pilot pressure applied to the surface of the diaphragm and an internal feedback pressure.

The pilot regulator 40*a* sets a pilot pressure based on a deviation signal between a predetermined setting pressure signal and the pressure P1. The pilot regulator 40*a* can quickly set the pressure P1 by adding to the deviation signal a differential signal of the pressure P1 and a differential signal of the pilot pressure. The primary pressure sensor 58 is disposed immediately in front of the variable orifice 42, and can set a region immediately in front of the variable orifice 42 to a pressure depending on the setting pressure signal, without being affected by any pressure loss inside the pipe passage between the variable orifice 42 and the booster regulator 60.

A pressure P2 in the supply pipe 44 and in the combustion chamber 28 may be a small pressure, which can stably be set by the pressure setting unit 40 and the variable orifice 42. Specifically, the pressure P2 should preferably be in the range of from 0.5 to 20.0 kPa, and more preferably be in the range of from 0.5 to 2.0 kPa. In the automatic tappet clearance adjusting apparatus 10, the pressure P2 is set to 1.5 kPa. In order to set the pressure P2 to 1.5 kPa, the pressure P1 of the upstream air supply source P1 is stably set to 10 kPa by the pressure setting unit 40.

Figure 3:
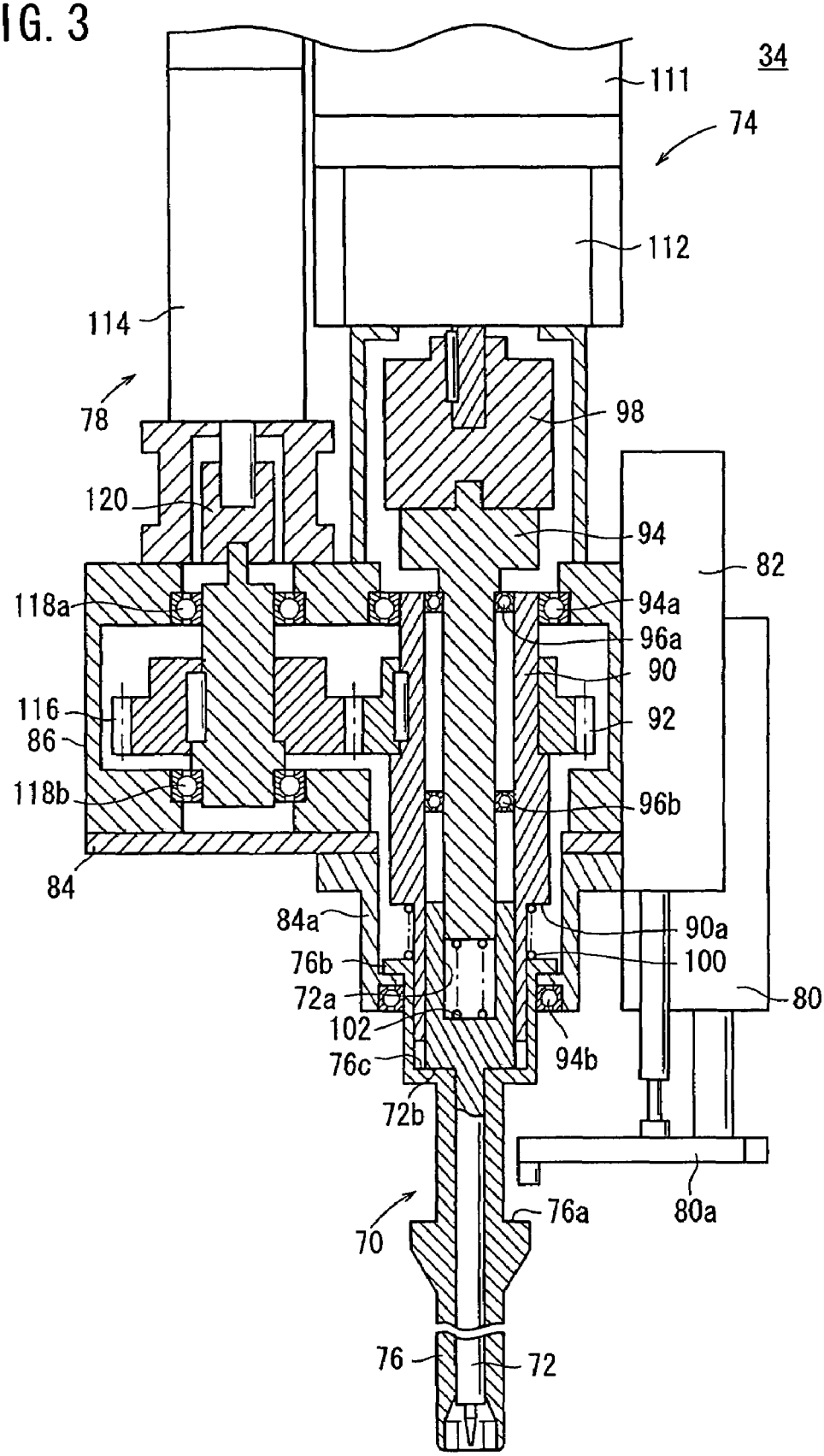
FIG. 3 is a sectional front elevational view of an adjustment unit.
Figure 4:
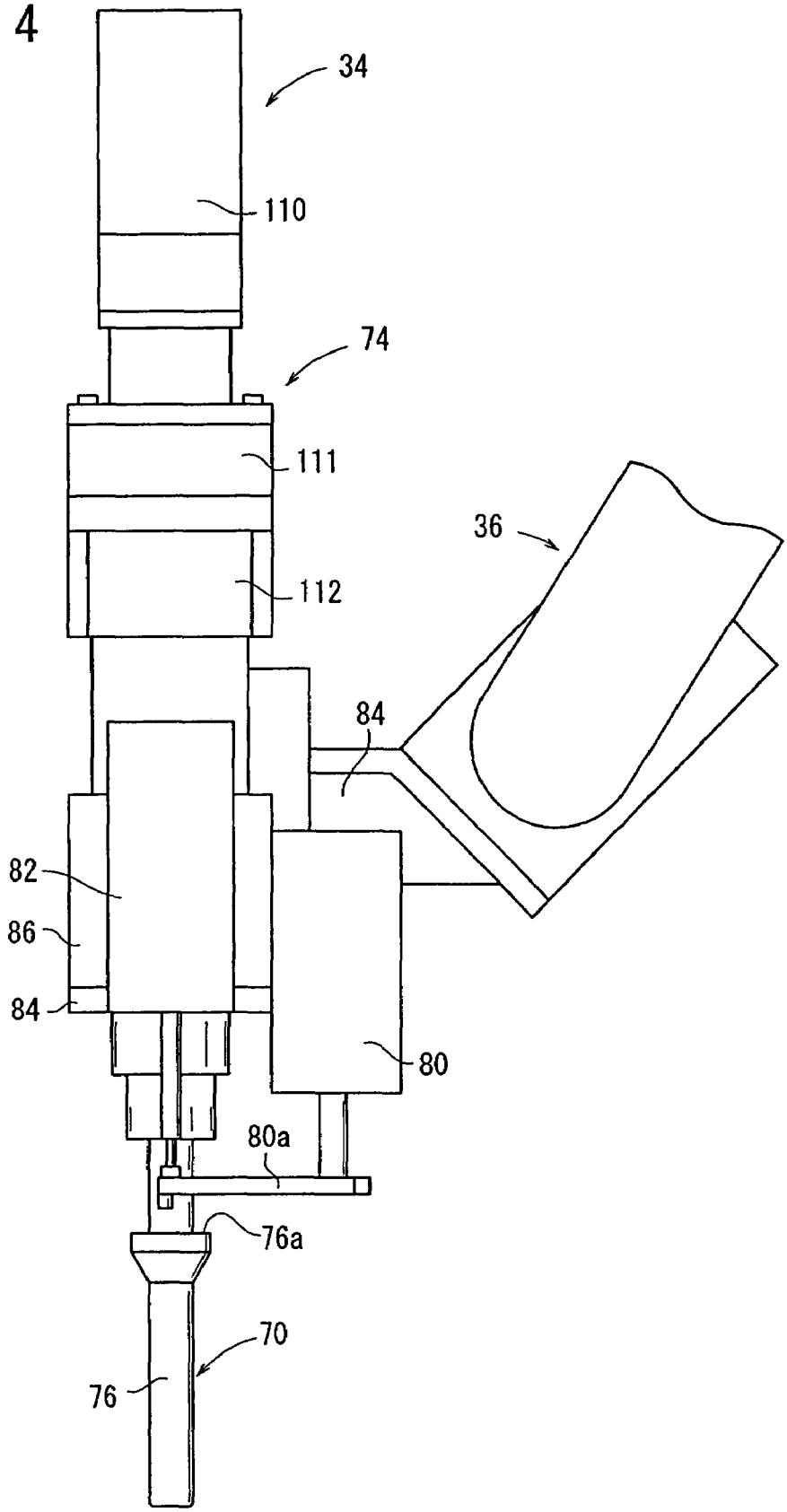
FIG. 4 is a side elevational view of the adjustment unit.

As shown in FIGS. 3 and 4, the adjustment unit 34 is mounted on the distal end of the robot 36. The adjustment unit 34 comprises a cylindrical working unit 70 for operating the adjustment screw 18 and the adjustment nut 23, a screwdriver 72 mounted in the distal end of a core shaft of the working unit 70, a screwdriver rotator 74 for actuating the screwdriver 72, a socket 76 disposed coaxially around the screwdriver 72, a nut runner 78 for actuating the socket 76, a pneumatic cylinder 80 for bringing a plate 80*a* into abutment against a detecting seat 76*a* in order to measure a distance by which the socket 76 is advanced or retracted, and a magnescale 82 coupled to the plate 80*a* for measuring the position of the detecting seat 76*a* in order to detect displacement of the rocker arm 22 in real time. The pneumatic cylinder 80 and the magnescale 82 are mounted on a joint bracket 84 connected to the robot 36. For making such measurements, the pneumatic cylinder 80 may be small in size and weight and does not need to produce a large output.

The screwdriver rotator 74 is mounted coaxially with the working unit 70 on an upper surface of the joint bracket 84 by a casing 86. The nut runner 78 is disposed adjacent and parallel to the screwdriver rotator 74, and extends upwardly from an upper surface of the casing 86.

As shown in FIG. 3, the working unit 70 projects downwardly from the joint bracket 84, while the screwdriver 72 and the socket 76 are disposed on the distal end of the working unit 70. The working unit 70 has a rotary tube 90 with a distal end having splines fitted into an upper hole in the socket 76, a driven gear 92 coaxially fixed onto the rotary tube 90 in the casing 86, and a coupling rod 94 extending through an axial hole in the rotary tube 90 and with a distal end having splines fitted into an upper hole 72*a* in the screwdriver 72.

The rotary tube 90 is rotatably supported in the casing 86 by bearings 94*a*, 94*b* in a support tube 84*a* projecting downwardly from the joint bracket 84. When the driven gear 92 is rotated, the rotary tube 90 is rotated in unison therewith, and such rotation is transmitted by the splines to rotate the socket 76. The coupling rod 94 is rotatably supported by two bearings 96*a*, 96*b* disposed on an inner surface of the rotary tube 90. When a coupling 98 mounted on the upper end of the coupling rod 94 is rotated, the coupling rod 94 is rotated in unison therewith, and rotation is transmitted by the splines to rotate the screwdriver 72.

A spring 100 is disposed between a side step of the rotary tube 90 and an upper end face of the socket 76, so as to resiliently bias the rotary tube 90 downwardly. The socket 76 has an outer ring 76*b* on an upper portion thereof, which engages in an inner annular groove in the support tube 84*a* in order to prevent the socket 76 from becoming dislodged.

A spring 102 is disposed between the lower end face of the coupling rod 94 and the bottom of the upper hole 72*a* in the screwdriver 72 so as to resiliently bias the screwdriver 72 downwardly. The screwdriver 72 has an outer step 72*b*, which engages an inner step 76*c* of the socket 76 in order to prevent the screwdriver 72 from becoming dislodged.

The screwdriver 72 has a straight lower distal end for engaging in the straight slot 18*a*. The socket 76 has a lower distal end having an inner circumferential surface with a hexagonal socket shape for engagement with the adjustment nut 23.

The screwdriver rotator 74 comprises a servomotor 110, the angular displacement R of which can be detected, a speed reducer 111 for transmitting rotation of the servomotor 110 at a reduced speed to the coupling 98, and a torque detector 112. The servomotor 110, the speed reducer 111, and the torque detector 112 are successively arranged in series from above.

The nut runner 78 includes a motor 114, a drive gear 116 for transmitting rotation of the motor 114 at a reduced speed to the driven gear 92, and bearings 118*a*, 118*b* supporting the shaft of the drive gear 116. A coupling 120 is disposed between the rotational shaft of the motor 114 and the drive gear 116. The motor 114, the drive gear 116, the coupling 120, the driven gear 92, and the bearings 118*a*, 118*b* are housed in the casing 86.

The magnescale 82 is capable of detecting displacement of the rocker arm 22 in real time. Therefore, based on the measured displacement of the rocker arm 22, the robot 36 can set the position and direction of the adjustment unit 34 so as to reliably hold the socket and the adjustment nut 23 in engagement with each other, and also to reliably hold the screwdriver 72 and the adjustment screw 18 in engagement with each other.

Figure 5:
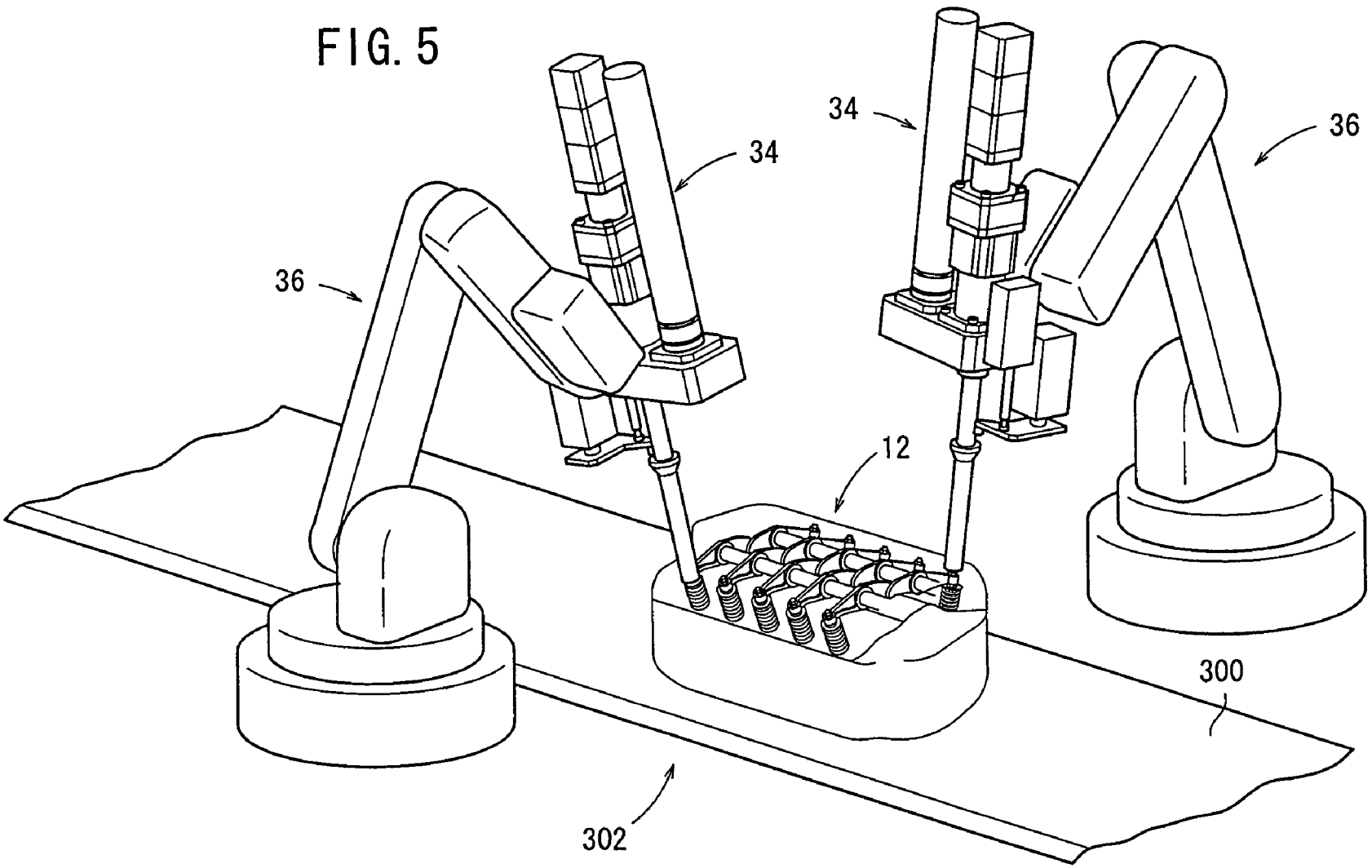
FIG. 5 is a perspective view of a station for making a tappet adjustment.

As shown in FIG. 5, the automatic tappet clearance adjusting apparatus 10 is installed in a station 302 on a production line 300. Engines 12 are successively fed along the production line 300. When an engine 12 is stopped at the station 302, the automatic tappet clearance adjusting apparatus 10 adjusts the tappet clearances C. After the tappet clearances C have been adjusted, the engine 12 is fed to a subsequent station. With this arrangement, the automatic tappet clearance adjusting apparatus 10 is capable of appropriately adjusting tappet clearances on mass-produced engines.

The station 302 has two automatic tappet clearance adjusting apparatuses 10 for sharing and adjusting adjustment screws 18, corresponding to a plurality of valves 14. Three or more automatic tappet clearance adjusting apparatuses 10 may be provided in a single station. The control mechanism 54 can be shared among all of the plural automatic tappet clearance adjusting apparatuses 10.

A method of adjusting the tappet clearance C in the engine 12 using the automatic tappet clearance adjusting apparatus 10 thus constructed shall be described below with reference to FIGS. 6 and 7.

Figure 6:
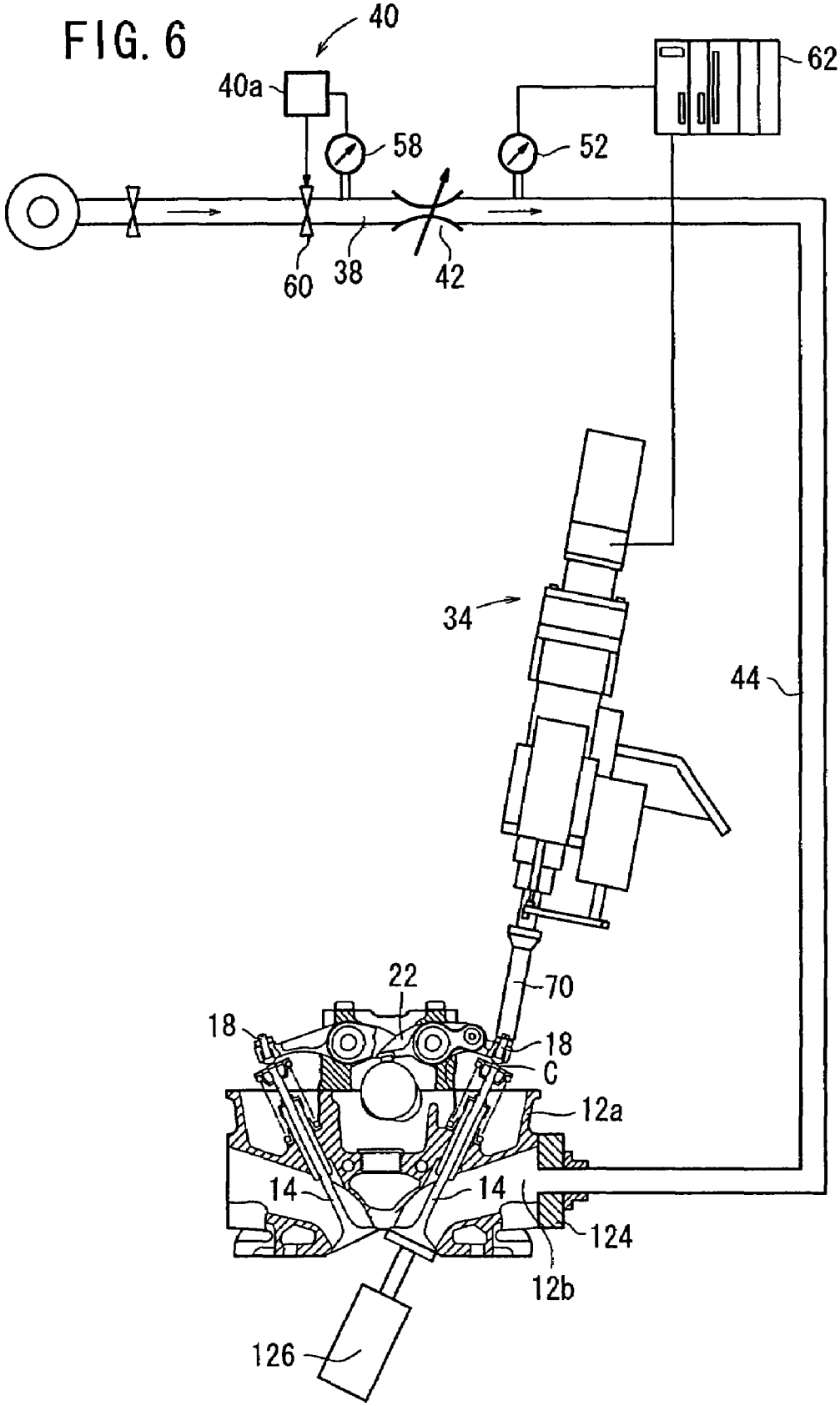
FIG. 6 is a block diagram showing the manner in which the automatic tappet clearance adjusting apparatus and the engine are connected for initial adjustment.

First, in an initial adjustment process, as shown in FIG. 6, a cylinder head 12*a* of the engine 12 is used, the supply pipe 44 is connected to an intake passage 12*b* by a sealed connection jig 124, and a magnescale 126 for measuring displacements is connected to a lower surface of the valve 14 on the intake side.

While a value measured by the magnescale 126 is being referred to, the screwdriver 72 is rotated by the control mechanism 54 in order to lower the valve 14 by a predetermined distance (e.g., 5 μm). Since the valve 14 is lowered, operation of the servomotor 110 is confirmed, and a gap corresponding to a piston ring 26*a* as viewed from the combustion chamber 28 can be simulatedly provided in the intake passage 12*b*. Then, while a value measured by the secondary pressure sensor 52 is referred to on a suitable monitor, the variable orifice 42 is manually adjusted to set the pressure P2 in the supply pipe 44 and the intake passage 12*b* to 1.5 kPa. A procedure for supplying compressed air into the combustion chamber 28 can thus simulatedly be carried out via the intake passage 12*b*, whereby the variable orifice 42 can appropriately be adjusted. Once adjusted, the variable orifice 42 does not need to be readjusted, insofar as the type of the engine 12 remains the same.

Figure 7:
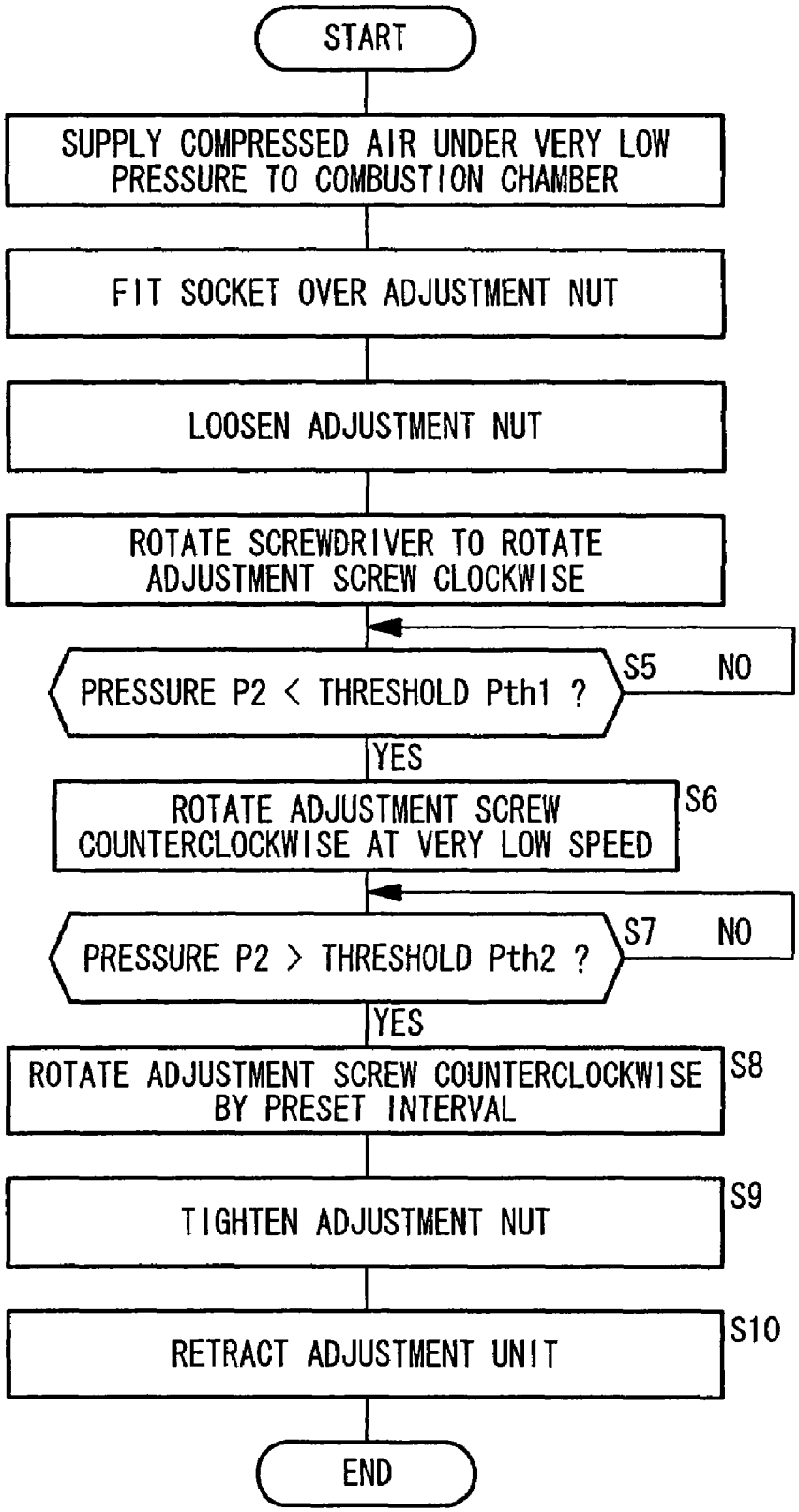
FIG. 7 is a flowchart showing a procedure for adjusting a tappet clearance with the automatic tappet clearance adjusting apparatus according to the first embodiment.

Then, the tappet clearance C is adjusted according to a procedure shown in FIG. 7. After the supply pipe 44 is connected using a predetermined connecting means to the ignition plug hole 30 of the engine 12 which has been delivered in place, the on-off valve 55 is opened to supply compressed air under a small pressure into the combustion chamber 28 in step S1. The compressed air causes a slight flow due to air leakage through the gap in the piston ring 26*a*. As described above, the air supply source 38 is stably set to 10 kPa by the pressure setting unit 40, and the combustion chamber 28 is set to 1.5 kPa by the variable orifice 42.

In step S2, the robot controller 64 operates the robot 36 to move the adjustment unit 34 closely to the engine 12, and to cause the socket 76 of the working unit 70 (see FIG. 4) to be fitted over the adjustment nut 23. At this time, since the adjustment unit 34 is moved by the robot 36, which has a high degree of freedom, under programmed operation of the robot controller 64, the adjustment unit 34 is flexible enough, even if the rocker arm 22 and the adjustment screw 18 have different positions and directions depending on the type of engine 12. A single automatic tappet clearance adjusting apparatus 10 can adjust the tappet clearances C of the cylinders of a multi-cylinder engine 12.

The distal end of the socket 76 floatingly abuts against the adjustment nut 23 and thereafter is fitted over the adjustment nut 23, whereupon the distal end of the socket 76 is seated on the rocker arm 22. Thereafter, the socket 76 moves slightly closer to the rotary tube 90 while resiliently compressing the spring 100, so that the distal end of the socket 76 is reliably fitted over the adjustment nut 23. Therefore, the robot 36 can bring the socket 76 into fitting engagement with the adjustment nut 23, in any desired position within a displacement range in which the spring 100 is resiliently deformable. At this time, the robot 36 can set the position and direction of the adjustment unit 34 based on the displacement of the rocker arm 22, which is measured by the magnescale 82, for thereby bringing the socket 76 into more reliable engagement with the adjustment screw 18.

At this time, the screwdriver 72 engages in the straight slot 18*a* of the adjustment screw 18 while resiliently compressing the spring 102.

In subsequent processes up to step S9, the robot 36 is synchronized in real time based on the displacement of the rocker arm 22, so as to bring the screwdriver 72 into accurate engagement within the straight slot 18*a*.

In step S3, the motor 114 of the nut runner 78 is energized to rotate the rotary tube 90 and the socket 76 in order to loosen the adjustment nut 23, thereby releasing the double-nut engagement applied by the adjustment nut 23 and the adjustment screw 18. The adjustment screw 18 is now made rotatable and can start to be adjusted by the screwdriver 72.

At this time, the adjustment nut 23 may be rotated in a direction so as to be loosened, while an increase in torque applied to the socket 76 can be detected by the torque detector 112 in order to confirm the fitting engagement between the socket 76 and the adjustment nut 23.

In step S4, the servomotor 110 of the screwdriver rotator 74 is energized to rotate the coupling rod 94 and the screwdriver 72, in order to rotate the adjustment screw 18 clockwise. The PLC 62 begins to measure the pressure value of the secondary pressure sensor 52 and the angular displacement R of the servomotor 110. The PLC 62 also measures the pressure value and the angular displacement R successively at predetermined small time intervals. Since the screwdriver 72 is biased so as to engage the adjustment screw 18 by the spring 102 (see FIG. 3), angular displacement R of the screwdriver 72 is proportional to the distance that the adjustment screw 18 is advanced or retracted. Therefore, measuring and controlling the angular displacement R is equivalent to measuring and controlling the distance that the adjustment screw 18 is advanced or retracted.

Figure 8:
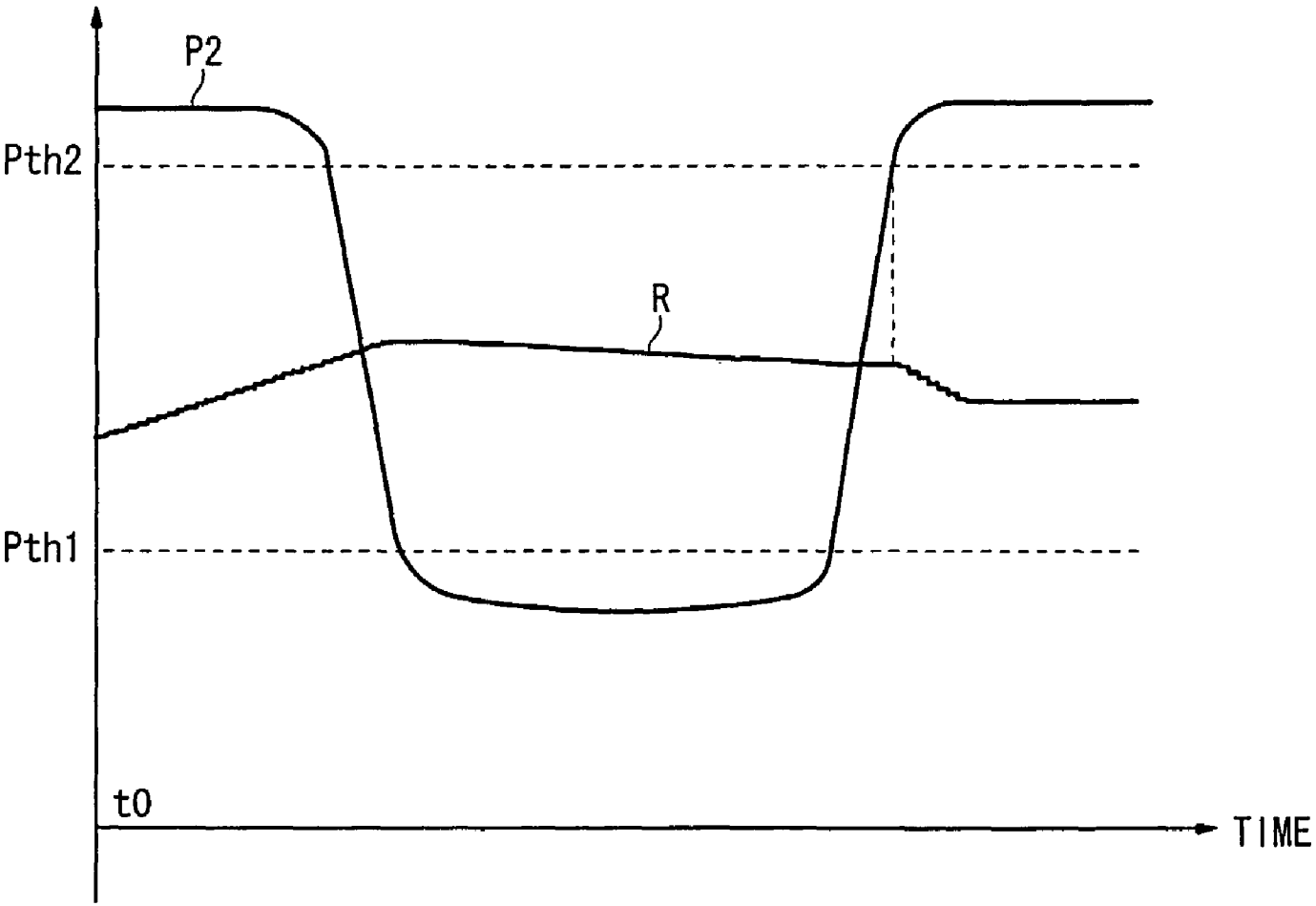
FIG. 8 is a graph of pressures and angular displacements at the time the tappet clearance is adjusted by the automatic tappet clearance adjusting apparatus according to the first embodiment.

FIG. 8 is a graph of pressure P2 measured by the secondary pressure sensor 52 and angular displacements R of the servomotor 110, as measured by the PLC 62, with time at this point being represented by t0.

Figure 9:
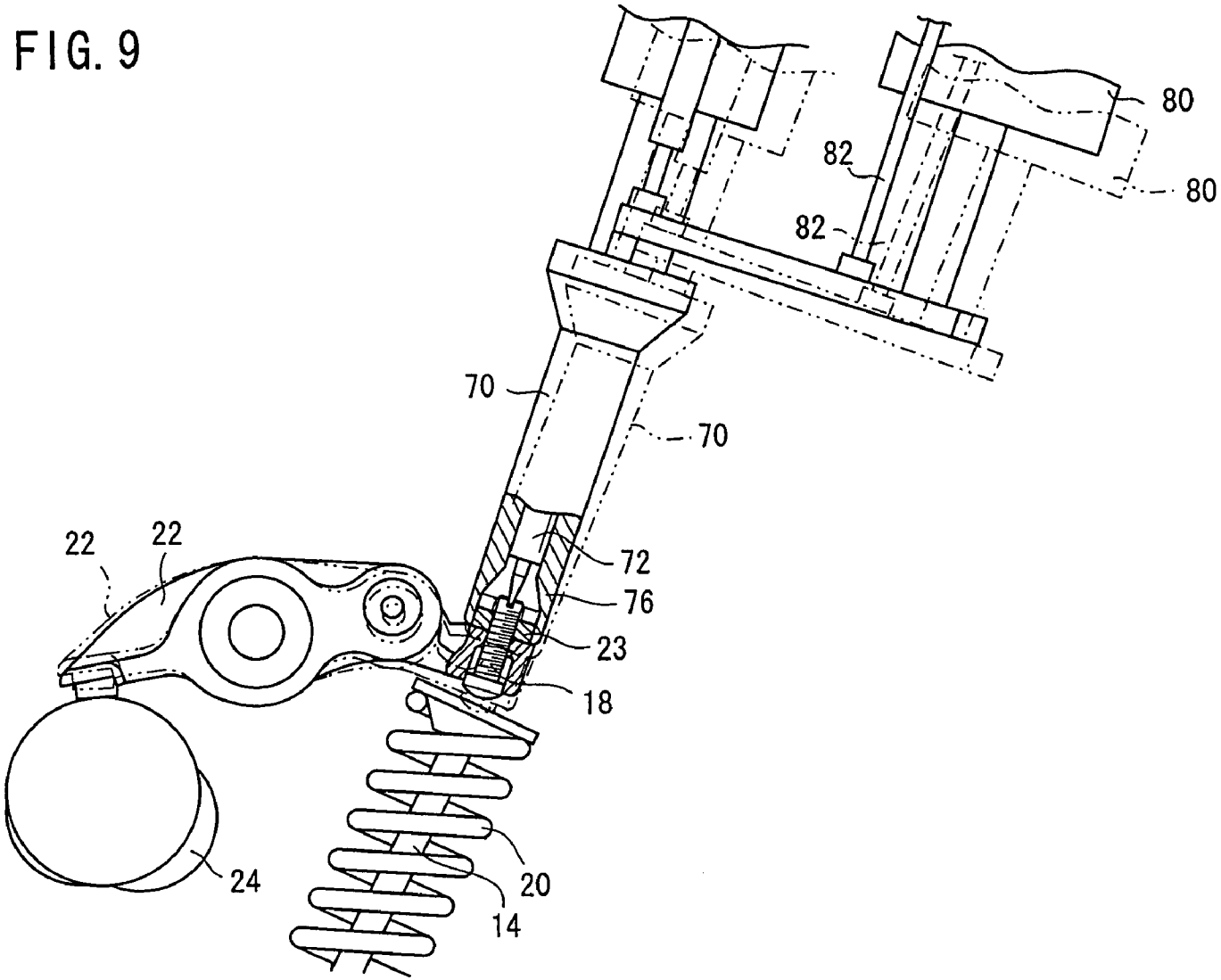
FIG. 9 is a view showing the manner in which the orientation of the adjustment unit is changed in synchronism with displacement of a rocker arm.

As shown in FIG. 9, in step S4, based on displacement of the rocker arm 22 as detected by the magnescale 82, the adjustment unit 34 is operated in synchronism to achieve an appropriate position and direction for smoothly rotating the adjustment screw 18. Specifically, the adjustment unit 34 may be synchronized so as to make the adjustment screw 18 and the screwdriver 72 coaxial with each other.

In step S5, the rotation of the adjustment screw 18 and the measurement of the pressure P2 by the secondary pressure sensor 52 are continued, and the control waits until the valve 14 is opened, thus causing the pressure P2 to drop from 1.5 kPa to a level lower than a threshold Pth1(=1.0 kPa). When the pressure P2 becomes lower than the threshold Pth1, control proceeds to step S6.

In step S6, the screwdriver rotator 74 operates to rotate the screwdriver 72 in the reverse direction so that the adjustment screw 18 is rotated counterclockwise at a very low speed.

In step S7, rotation of the adjustment screw 18 and measurement of the pressure P2 are continued, and the control waits until the valve 14 is closed, thereby causing the pressure P2 to exceed a threshold Pth2(=1.4 kPa). When the pressure P2 exceeds the threshold Pth2, the angular displacement R of the servomotor 110 at that time is recorded as a 0 point, which serves as a reference point indicating where the valve 14 is closed, and control then proceeds to step S8.

In step S8, the screwdriver 72 rotates the adjustment screw 18 counterclockwise further by a given preset interval. The preset interval has been calculated in advance based on an appropriate value (e.g., 0.3 mm) that is preset in design for the tappet clearance C. The adjustment screw 18 is now retracted from the reference position by the preset interval, and the tappet clearance C reaches a value very close to the appropriate value that is preset in design. At this time, the screwdriver 72 stops being rotated. Since the screwdriver 72 does not need to stop being rotated while the pressure P is being monitored, the adjustment screw 18 may be rotated at a relatively high speed.

In step S9, the nut runner 78 operates to tighten the adjustment nut 23, fixing the adjustment screw 18.

In step S10, the robot 36 operates to retract the adjustment unit 34. If another adjustment screw 18 remains unadjusted, then steps S1 through S10 are executed repeatedly on the unadjusted adjustment screw 18.

In the automatic tappet clearance adjusting apparatus 10 according to the first embodiment, the air supply source 38 has a pressure thereof regulated based on the value measured by the primary pressure sensor 58 according to an electric feedback loop, and the pressure thereof is set to a small pressure of 10 kPa. Therefore, the air supply source 38 has a high response, which is about 1/10 of the response that would be achieved if a mechanical regulator were used to set a high pressure. Also, the air supply source 38 can maintain a stable pressure, which experiences only small pressure variations. Therefore, a high response is provided while a stable pressure is maintained in both the supply pipe 44 and the combustion chamber 28 downstream of the air supply source 38. In other words, the pressure P1 can sufficiently catch up with any air leakage from the piston ring 26*a*, and a stable pressure can be kept, regardless of different shapes of the piston 26 and the piston ring 26*a*.

Inasmuch as the variable orifice 42 causes a small pressure loss of 8.5 kPa(=P1−P2=10−1.5), heat generated by energy loss is small, and air that passes through the orifice 42 experiences only a small air viscosity change due to the temperature change. Therefore, the measurement of pressures is not susceptible to heat, and can be performed highly accurately with reduced fluctuations. Since the pressure loss across the variable orifice 42 is small, air flow disturbances are small and pressures can be measured stably, and accordingly, the 0 point where the valve 14 is closed can be identified highly accurately.

Because the pressure P2 applied to the combustion chamber 28 is very low, the pressure borne by the piston 26 is small, thereby preventing the piston 26 from being lowered or vibrated. Consequently, there is no need to provide a mechanism for securing the piston 26 and the crankshaft (not shown). Since the piston 26 is set to top dead center, the volume of the combustion chamber 28 is small enough to be filled with compressed air quickly, so that adjustments can be started early. If a small air leakage occurs when the valve 14 is opened, then a noticeable pressure variation occurs, thus allowing the behavior of the valve 14 to be monitored with ease.

The engine 12 has a plurality of valves 14 per each cylinder for performing intake and exhaust operations. As a result of supplying the combustion chamber 28 with compressed air, each of the valves 14 on the same cylinder can be adjusted with the same piping arrangement, without the need for changing the destination of the supplied compressed air.

All the processes performed by the automatic tappet clearance adjusting apparatus 10 for conducting tappet clearance adjustments are automatically carried out under control of the control mechanism 54. Therefore, the automatic tappet clearance adjusting apparatus 10 is effective as a labor saver for several workers, and the apparatus is capable of adjusting tappet clearances more quickly and accurately than workers. Furthermore, inasmuch as the automatic tappet clearance adjusting apparatus 10 can selectively and flexibly carry out a plurality of operations under a programmed control, the apparatus is suitable for adjusting a large quantity of engines 12 having a wide variety of engine types.

The engine 12 that is adjusted by the automatic tappet clearance adjusting apparatus 10 is a complete product made up of an assembly of major components including a cylinder head, pistons 26, and a crankcase. The adjustment process is done as an independent process after assembly of the engine 12 has been completed. Since no subsequent assembling process is required, the adjustment once it has been made is not changed. The adjustment process is also simple, since no advance disassembling process is needed.

An automatic tappet clearance adjusting apparatus 200 according to a second embodiment of the present invention shall be described below with reference to FIGS. 10 through 13. The automatic tappet clearance adjusting apparatus 200 operates to adjust a tappet clearance C, similar to the automatic tappet clearance adjusting apparatus 10. Those parts of the automatic tappet clearance adjusting apparatus 200, which are identical to those of the automatic tappet clearance adjusting apparatus 10, are denoted using identical reference characters, and detailed descriptions of such parts shall not be provided below.

Figure 10:
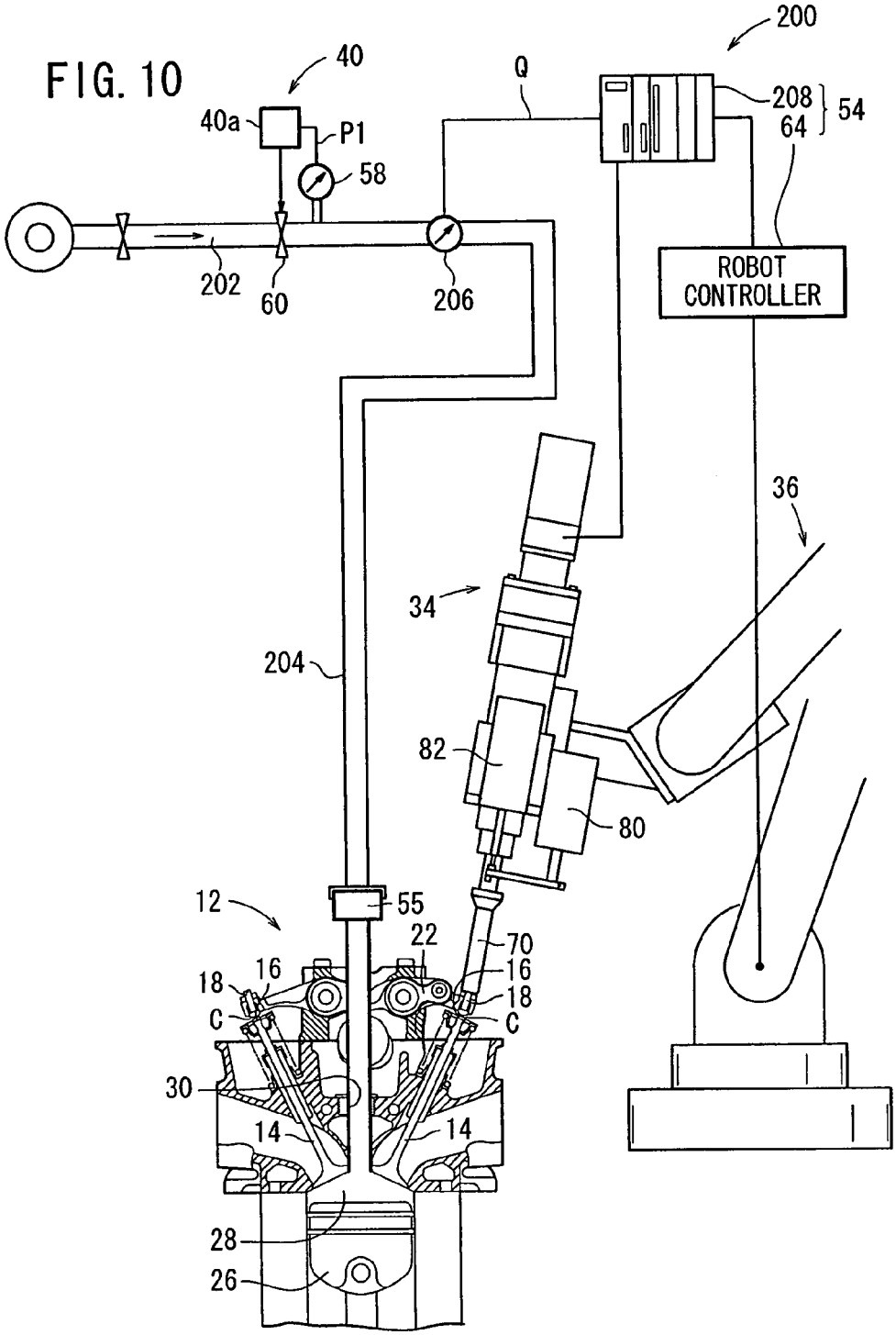
FIG. 10 is a block diagram of an automatic tappet clearance adjusting apparatus according to a second embodiment of the present invention.

As shown in FIG. 10, the automatic tappet clearance adjusting apparatus 200 comprises an adjustment unit 34, a robot 36 equipped with the adjustment unit 34, a supply pipe 204 extending from an air supply source 202 and communicating with a combustion chamber 28 of the engine 12, a pressure setting unit 40 electrically operable to adjust the pressure in the supply pipe 204 so as to be maintained at a constant pressure, a flow rate sensor 206 for measuring a flow rate in the supply pipe 204, and a control mechanism 54 for controlling the adjustment unit 34 based on a measured signal from the flow rate sensor 206. The supply pipe 204 also includes an on-off valve 55. The control mechanism 54 includes a PLC 208 and a robot controller 64. The PLC 208 is structurally identical to the PLC 62, but is programmed differently. Pressure in the supply pipe 204 is regulated to 1.5 kPa by the pressure setting unit 40.

Figure 11:
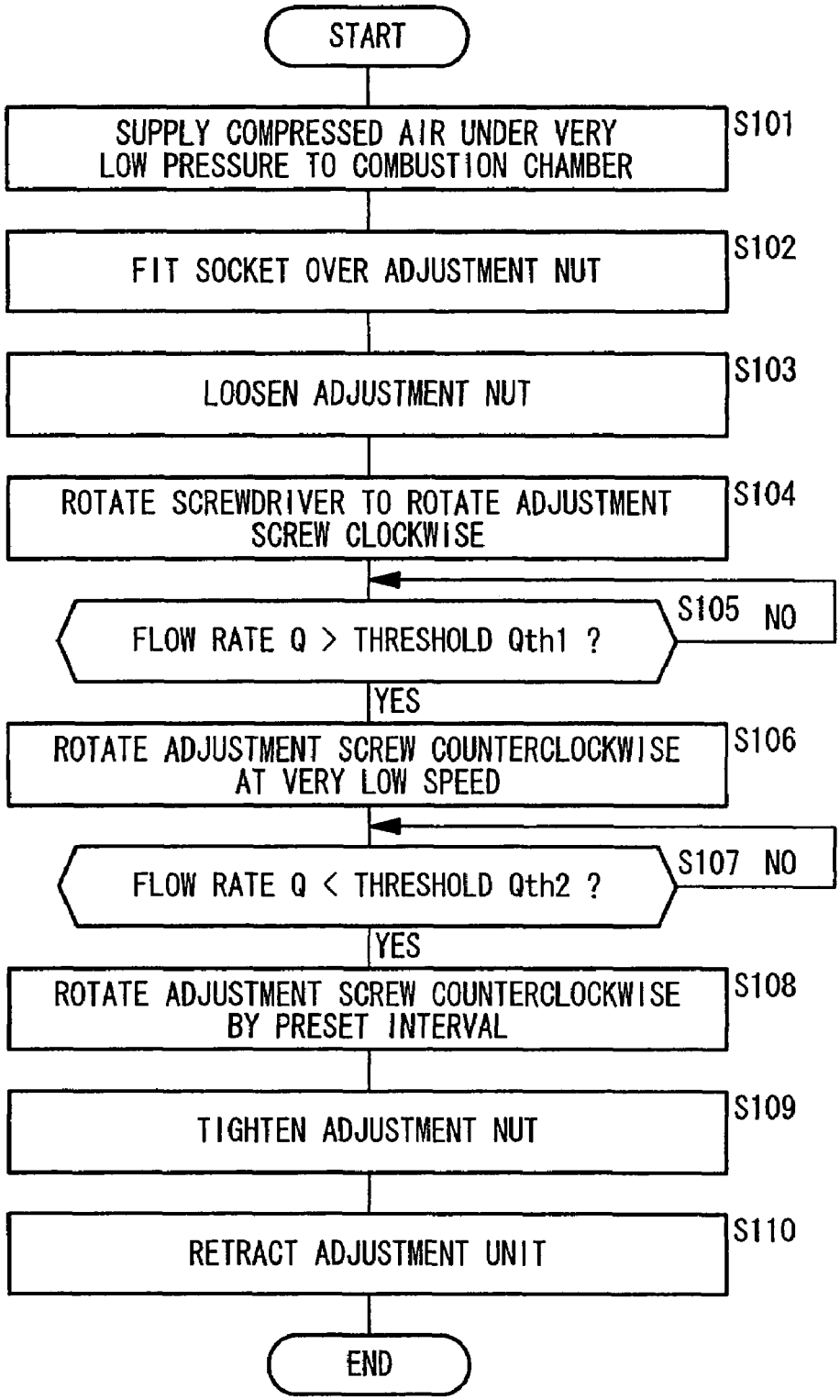
FIG. 11 is a flowchart showing a procedure for adjusting a tappet clearance with the automatic tappet clearance adjusting apparatus according to the second embodiment.

The automatic tappet clearance adjusting apparatus 200 adjusts the tappet clearance C according to the processing sequence shown in FIG. 11. As can be understood from FIGS. 11 and 7, whereas the automatic tappet clearance adjusting apparatus 10 identifies the 0 point for the valve 14 based on the pressure P2 measured by the secondary pressure sensor 52, the automatic tappet clearance adjusting apparatus 200 identifies the 0 point based on a flow rate Q measured by the flow rate sensor 206.

The comparison between the pressure P2 and the threshold Pth1 in step S5 is replaced with a comparison between the flow rate Q and a predetermined threshold Qth1 (step S105). Further, the comparison between the pressure P2 and the threshold Pth2 in step S7 is replaced with a comparison between the flow rate Q and a predetermined threshold Qth2 (step S107). Other steps S101 through S104 and steps S106 and S108 through S110 are carried out in the same manner as steps S1 through S4 and steps S6 and S8 through S10.

Specifically, after steps S101 through S104, in step S105, the adjustment screw 18 is rotated while the flow rate Q is measured, and the control waits until the valve 14 is opened sufficiently to cause the flow rate Q to exceed the threshold Qth1. It can be understood that if the pressure is constant (1.5 kPa), the flow rate Q increases when the valve 14 is opened.

After step S106, in step S107, the control waits until the valve 14 is closed sufficiently to cause the flow rate Q to drop below the threshold Q2. The angular displacement R of the servomotor 110 at the time the flow rate Q drops below the threshold Q2 is recorded as the 0 point where the valve 14 becomes closed. Then, steps S108 through S110 are successively executed.

Figure 12:
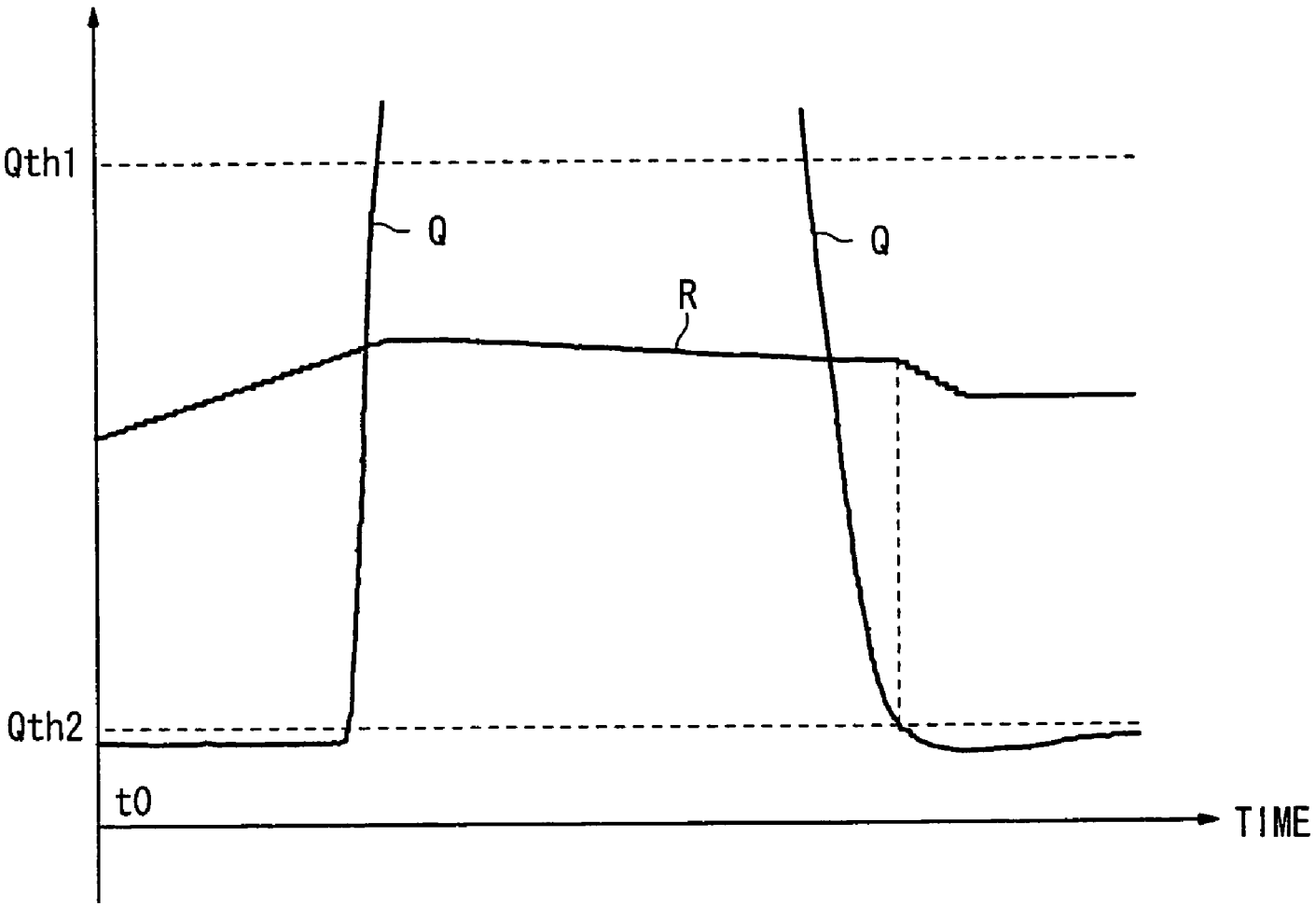
FIG. 12 is a graph of valve displacements at the time the tappet clearance is adjusted by the automatic tappet clearance adjusting apparatus according to the second embodiment.

FIG. 12 is a graph showing flow rates Q, which are represented by measured values from the flow rate sensor 206, and angular displacements R of the servomotor 110, which are measured by the PLC 62.

Figure 13:
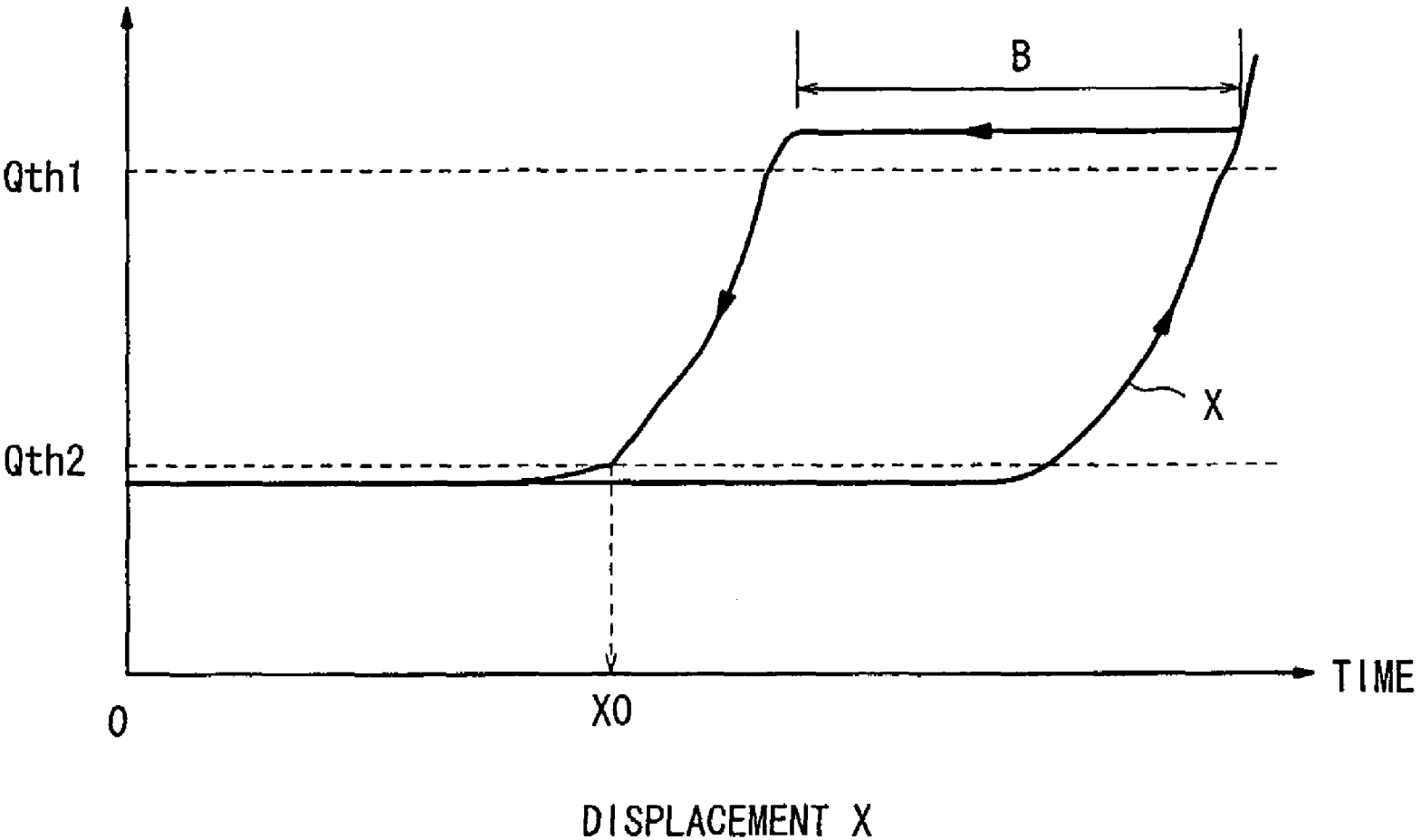
FIG. 13 is a graph of flow rates and angular displacements at the time the tappet clearance is adjusted by the automatic tappet clearance adjusting apparatus according to the second embodiment.

The automatic tappet clearance adjusting apparatus 200 produces a stable flow rate and thus offers the same advantages as the automatic tappet clearance adjusting apparatus 10. As shown in FIG. 13, the relationship between the displacement X of the valve 14 and the flow rate Q is represented by a hysteresis curve, due to backlash B, etc. However, highly accurate adjustments that are not susceptible to backlash can be made by identifying a displacement X0, which provides the 0 point when the valve 14 is closed.

The automatic tappet clearance adjusting apparatus according to the present invention is not limited to the above embodiments, but may have various arrangements without departing from the gist of the present invention.

The invention claimed is:

1. An automatic tappet clearance adjusting apparatus for adjusting a clearance between a valve and an adjustment screw in an engine in which said valve, that is normally closed by a spring, is temporarily opened by being pressed by said adjustment screw on a distal end of a rocker arm, said automatic tappet clearance adjusting apparatus comprising:

an adjustment unit for advancing and retracting said adjustment screw from the distal end of said rocker arm to adjust a projection of said adjustment screw;

a pressure setting unit for adjusting the pressure of an air supply source so as to maintain a constant pressure in accordance with an electric feedback loop and based on a measured signal from a primary pressure sensor for measuring the pressure of said air supply source;

a supply pipe extending from said air supply source and communicating with a combustion chamber through a restriction and an ignition plug hole; and a control mechanism for controlling said adjustment unit based on a measured signal from a secondary pressure sensor for measuring the pressure in said supply pipe, wherein the pressure in said supply pipe and said combustion chamber when said valve is closed is set to a pressure in the range from 0.5 to 20.0 kPa.

2. An automatic tappet clearance adjusting apparatus according to claim 1, wherein said restriction comprises a variable orifice.

3. An automatic tappet clearance adjusting apparatus according to claim 1, wherein said adjustment unit is moved by a programmable multiaxis robot.

4. An automatic tappet clearance adjusting apparatus according to claim 1, wherein said engine comprises a piston set to a top dead center.

5. An automatic tappet clearance adjusting apparatus according to claim 1, wherein the apparatus is installed in a station on a production line.

* * * * *